US006159108A

United States Patent [19]

de la Peña

[11] Patent Number: 6,159,108

[45] Date of Patent: Dec. 12, 2000

[54] GOLF BALL PLACEMENT DEVICE

[76] Inventor: Gil de la Peña, 3059 Strand Rd., Rocklin, Calif. 95769

[21] Appl. No.: 09/354,991

[22] Filed: Jul. 15, 1999

[51] Int. Cl.[7] ..... A63B 53/00

[52] U.S. Cl. ..... 473/286

[58] Field of Search ..... 294/19.2; 473/219, 473/226, 282, 286

[56] References Cited

U.S. PATENT DOCUMENTS

| | | | |
|---|---|---|---|
| 2,561,815 | 7/1951 | Oberg | 473/286 X |
| 3,462,184 | 8/1969 | Russell | 473/286 X |
| 4,787,632 | 11/1988 | Nigrelli et al. | 473/286 X |
| 4,968,079 | 11/1990 | Burton | 294/19.2 |
| 5,460,366 | 10/1995 | Pugh | 294/19.2 X |
| 5,645,498 | 7/1997 | Cretella | 473/286 X |
| 5,651,742 | 7/1997 | Dickson | 294/19.2 X |
| 5,690,558 | 11/1997 | Huber | 473/286 X |
| 5,765,647 | 6/1998 | Hood | 294/19.2 X |

*Primary Examiner*—John A. Ricci

*Attorney, Agent, or Firm*—Risto Rinne, Jr.

[57] ABSTRACT

An apparatus for the placement of a golf ball onto a Tee includes a triangular shaped top plate and an attached back plate disposed at an angle with respect to the top plate. Adhesive tape or a hook and loop fastener are attached to the inside portions of the top and back plate. The adhesive tape, if used, adheres the top and back plates to a top and back surface of a golf club. If the hook and loop fastener is used, a corresponding part of the fastener is attached to the top and back surfaces of the golf club. A neck is attached to the interface where the top and back plates intersect. A pair of arcuate forks each attach to the neck and extend away from the top plate in a small and generally upward arc that aligns with the arc of the club when swung. The forks can be used to scoop up the golf ball or pressed down over the ball until they expand sufficient to allow passage over the ball and contraction under the ball sufficient to retain the ball in place. The club is then maneuvered so as to place the ball on the Tee. A gap is provided intermediate each of the pair of forks that allows passage of the device past the Tee. The club is then used to strike (impel) the ball with the device attached thereto.

12 Claims, 3 Drawing Sheets

GOLF BALL PLACEMENT DEVICE

BACKGROUND OF THE INVENTION

1. Field of the Invention

The present invention, in general relates to devices that assist in the placement of a golf ball prior to striking the ball with a club and, more particularly, to golf ball placement devices that attach to a golf club driver.

At a golf practice range it is necessary to place a great many golf balls on a practice Tee, and then hit the balls with a golf club. This process typically requires setting down and releasing of the golf club, stooping down to pick up a ball from a bucket of golf balls, placing the ball by hand on the Tee, picking up the golf club, and then striking the ball.

This process slows down the practice and forces the golfer to make motions unrelated to the perfection of his or her golf swing. In particular, many people find the bending over to pick up a golf ball and having to place it on the Tee to be somewhat difficult and even annoying to do.

Devices to assist in the process that attach to shoes are known but they require balancing on one foot in order to pick up a golf ball placed on the ground and continuing to balance on one foot as it is placed on the Tee. This is difficult for most people to accomplish.

While any type of a golf club can be used at a practice range, it is common to use a type of a golf driver. Drivers have an enlarged head and low angle designed to impel a ball (or drive it as it is known in golfing circles) as long a distance as possible. They are normally used for the initial golf stroke at most golf holes and typically occur after a ball has been placed on the golf Tee. The Tee is only used for the initial shot.

At a practice range, the golf ball is also placed on an elastomeric (rubber) Tee prior to striking it. Therefore, the use of a practice range most closely proximates the initial shot in golf, one that is predominantly accomplished by the use of a driver as the preferred golf club.

It also is not always convenient to "scoop" up the golf ball off of the ground surface at the practice range. An attempt at scooping can cause the ball to roll away, thereby increasing the frustration level of the golfer, regardless of how well, or how poorly, the practice session is transpiring.

Conversely, sometimes it is desirable to be able to scoop up the golf ball, especially when it is prevented from rolling away from the golfer. Furthermore, some golfers find the scooping to be an art form and actually enjoy attaining a level of proficiency at it.

It would also be desirable if this device could attach to the golf driver, providing of course that the device did not impede use of the driver. Ideally, the device would be detachably-attachable to the driver, so that it could be removed whenever removal of the device was preferred, such as when the driver is being used during actual play instead of at the practice range.

It's use with the golf club is advantageous for two main reasons. The first is because the golf club must extend sufficiently far so as to reach the ground surface. Its use in picking up a golf ball would not require the golfer to bend any more than he or she would during normal use of the golf club. In fact, such use can be said to provide the perfect range of exercise related to flexing sufficient to strike a golf ball with a golf club if the golf club is itself used to pick up practice golf balls.

And secondly, the use of the golf club to pick up balls would permit the golfer to maintain his or her grip on the club between shots, also desirable.

However, golf clubs and in particular golf club drivers have a wide range of shapes, sizes, and profiles. It is desirable for any device to fit as many of them as possible.

Accordingly there exists today a need for a device that allows a golfer to keep both feet on the ground and to pick up and place a golf ball on a golf Tee prior to striking it with a golf club, and in particular with a golf driver, and where the golfer is not required to either bend over or let go of the golf club and where the device is detachably-attachable with respect to the golf club.

Clearly, such an apparatus would be a useful and desirable device that could expedite the practice session while making it more enjoyable to the golfer.

2. Description of Prior Art

Golf ball setters and related types of devices are, in general, known. For example, the following patents describe various types of these devices:

U.S. Pat. No. 2,561,815 to Oberg, Jul. 24, 1951; and

U.S. Pat. No. 5,651,742 to Dickson, Jul. 29, 1997;

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a golf ball placement device that can be used to scoop golf balls from the ground surface.

It is also an important object of the invention to provide a golf ball placement device that can be used to acquire golf balls by pressing the device down on top of a golf ball.

Another object of the invention is to provide a golf ball placement device that can be attached to a golf club.

Still another object of the invention is to provide a golf ball placement device that can be detached from a golf club.

Still yet another object of the invention is to provide a golf ball placement device that is attachably-detachable from a golf club.

Yet another important object of the invention is to provide a golf ball placement device that can be used with a golf club driver.

Still yet another important object of the invention is to provide a golf ball placement device that can be used with a variety of golf club drivers.

Still yet another especially important object of the invention is to provide a golf ball placement device that is inexpensive to manufacture.

Briefly, a golf ball placement device for use with a golf club that is constructed in accordance with the principles of the present invention has a top plate adapted for attachment to the top of a golf club, an arcuate back plate attached to the top plate and adapted for attachment to the rear of a golf club, a pair of arcuate forks attached to the back plate and adapted for scooping up a golf ball and for acquisition of a golf ball by pressing them down over the golf ball with sufficient force to cause them to expand enough to pass over the golf ball and to retract under the ball sufficient to hold the ball in place, and wherein the pair of forks are disposed apart from each other sufficient to permit passage over a golf Tee. The top plate and back plate are detachably-attachable to the golf club by the use of double stick tape, an adhesive, or a VELCRO or similar brand of hook and loop fastener.

DETAILED DESCRIPTION OF THE INVENTION

Figure 1:
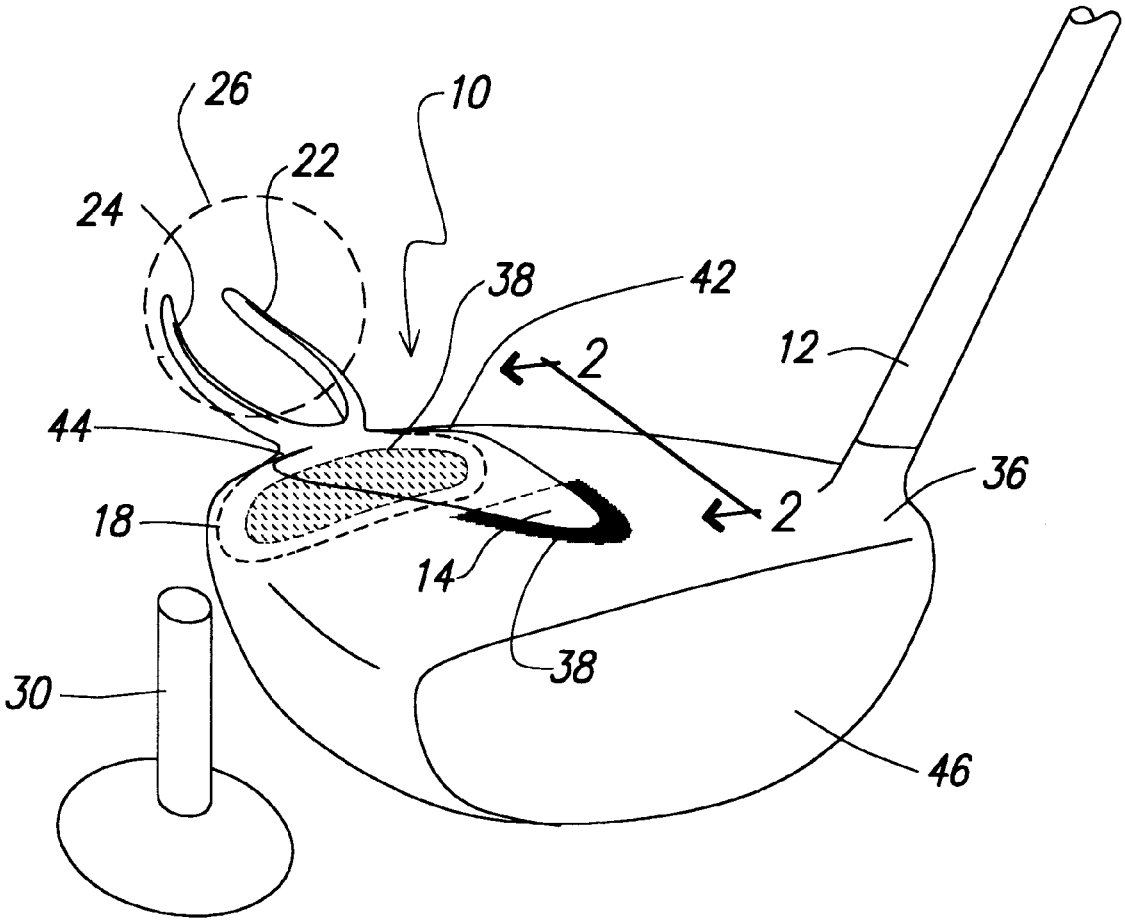
FIG. 1 is a view in perspective of a golf ball placement device attached to a golf club.
Figure 2:
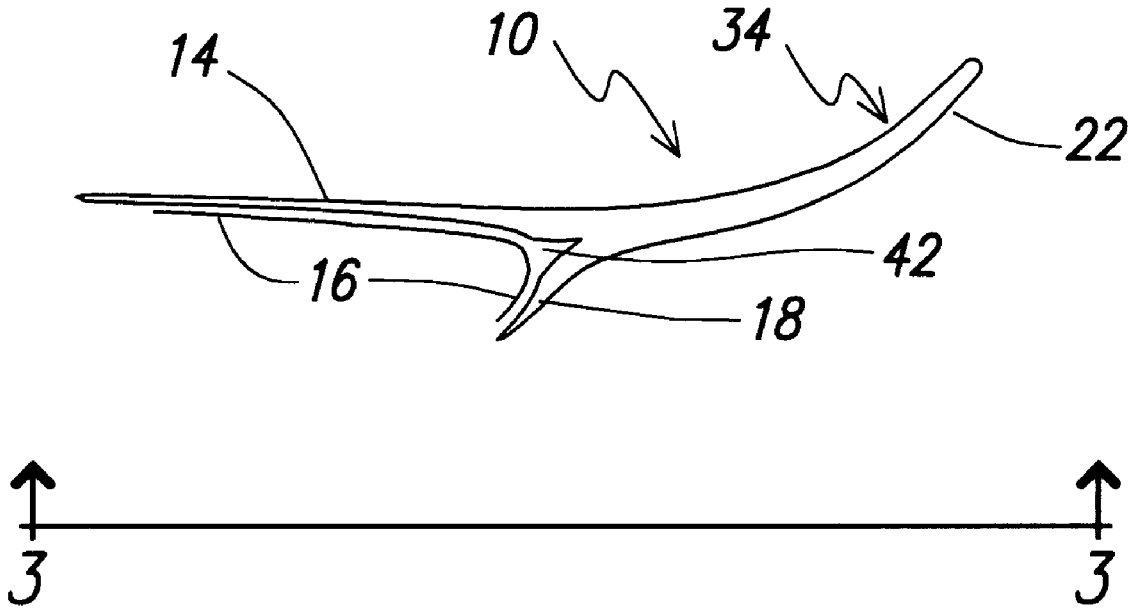
FIG. 2 is a view as shown in FIG. 1 as seen along the lines 2—2 therein and absent the golf club showing a side view of the device.
Figure 3:
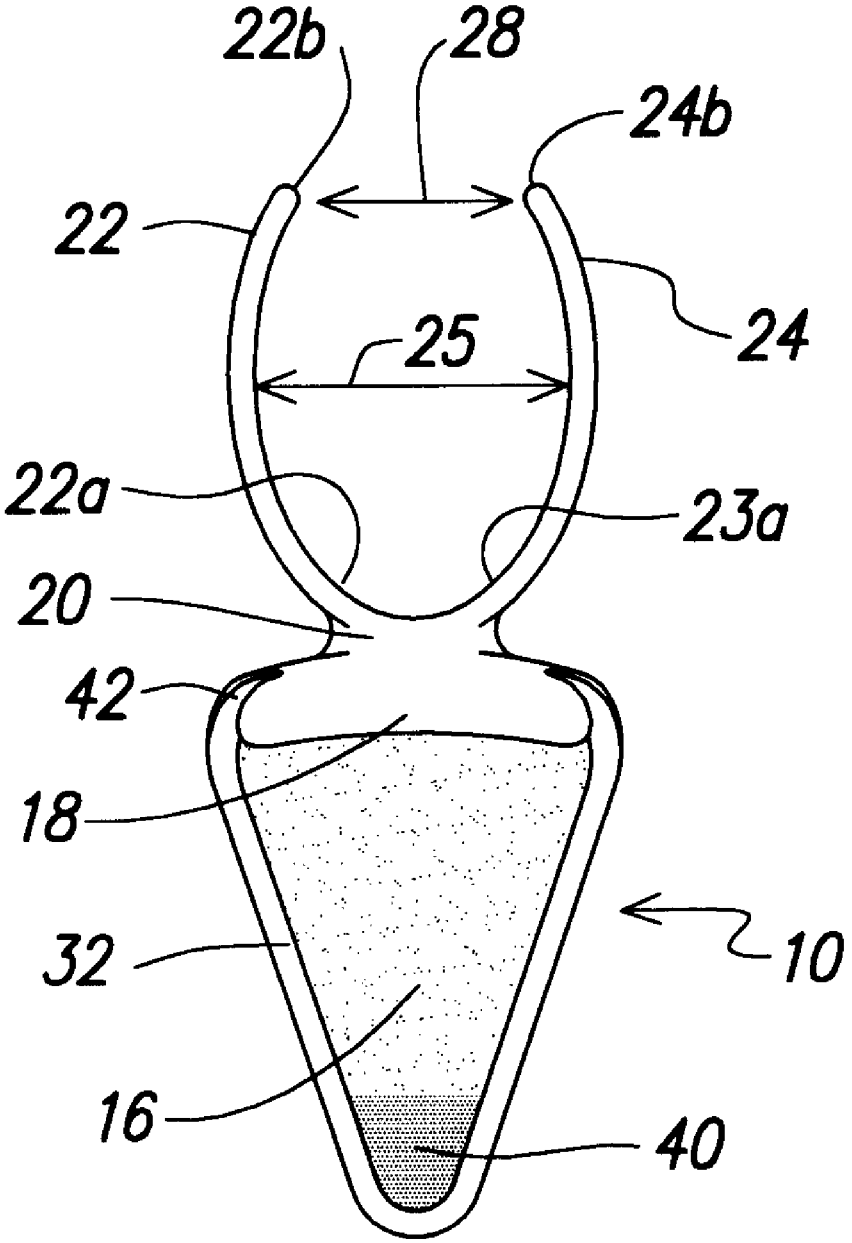
FIG. 3 is a view as shown in FIG. 2 as seen along the lines 3—3 therein showing a bottom view of the device.

Referring on occassion to FIGS. 1–3 is shown, a golf ball placement device, identified in general by the reference numeral 10 attached to a golf club 12.

A top plate 14 is attached to the top of the club 12 by an adhesive tape 16. The adhesive tape also extends around to include its placement on a portion of a back plate 18 that also makes contact with the club 12. Attachment of the device 10 to the club 12 is discussed in greater detail hereinafter.

The top plate 14 is triangular in shape and constructed as thin as possible to minimize wind resistance. Its weight, as well as the weight of the device 10 are kept to a minimum so as to maintain the same "feel" when swinging the club 12, whether the device 10 is attached to the club 12 or not.

The back plate 18 is attached at a first end to the top plate 14 and extends downward therefrom at an angle somewhat less than 90 degrees so as to better contact the surfaces of the club 12.

A neck 20 is attached at one end thereof to the interface between the top plate 14 and the back plate 18. A first arcuate fork 22 and a second arcuate fork 24 are attached at a first fork first end 22*a* and a second fork first end 24*a* respectively to the neck 20 at an end opposite to where the neck 20 is attached to the top and back plates 14, 18.

The first fork 22 is disposed a predetermined distance, identified by arrow 25, apart from the second fork 24 that at its maximum, is less than the diameter of a golf ball, the golf ball being shown in dashed lines and identified by the reference numeral 26 in FIG. 1.

The first and second forks 22, 24 curve, in general, toward each other and if they were extended further in length than they are, they would eventually curve back and touch each other. The center opening is generally elliptical in shape.

The first and second forks 22, 24 cannot in fact be extended in length or otherwise permitted to touch each other for reasons as are described in greater detail hereinafter.

The first fork 22 includes a first fork second end 22*b* that is disposed opposite with respect to the first end 22*a* thereof. The second fork 24 includes a second fork second end 24*b* that is disposed opposite with respect to the first end 24*a* thereof.

A gap, identified by the reference arrow 28, defines the distance the first fork second end 22*b* is from the second fork second end 24*b*. The gap 28 must exceed the diameter of a golf Tee 30.

The first and second forks 22, 24 define a pair of forks (not indicated by a reference numeral) that are adapted to either scoop or acquire by pressing down on the golf ball 26. Once acquired, the pair of forks 22, 24 are adapted to support the golf ball 26 until it is placed on the Tee 30, as is described in greater detail hereinafter.

If desired, the top plate 14 or the back plate 18 or both include a recessed area 32 that is adapted to receive the adhesive tape 16 therein. The purpose of the recessed area 32 is to prevent the adhesive tape 16 from protruding excessively from the device 10, thereby elevating the device 10 from the club 12. Ideally, the device 10 is maintained in close proximity to the club 12 to minimize air resistance and also to improve its appearance.

Referring now momentarily and in particular to FIG. 2, the pair of forks 22, 24 extend in an arc, identified by radius arrow 34 in a direction that is generally up and away from a ground surface (not shown). The radius 34 causes the pair of forks 22, 24 to fall along a second arc (not shown) that corresponds, generally, with the path a head 36 of the golf club 12 will follow when a golfer (not shown) strikes the ball 26 with it.

The placement of the pair of forks 22, 24 along the arc 34 further minimizes the potential for creating additional wind resistance from the device 10. It also aids in the retention of the golf ball 26 when the ball 26 is disposed on the pair of forks 22, 24.

The use of the adhesive tape 16 represents one way of attaching the device 10 to the club 12. When desired, the device 10 can be pulled off of the club 12 and the adhesive tape 16 can be removed from the device 10. The adhesive tape 16 includes adhesive on both sides and is sometimes referred to as double stick tape (because both surfaces are adhesive). After a few removals and reapplications to the club 12, the adhesive tape 16 will deteriorate or otherwise lose its ability to hold the device 10 to the club 12.

A new adhesive tape (not shown) can then be applied and the device 10 once again secured to the club 12.

The adhesive tape 16 can be formed of one large piece or two or more smaller pieces, if desired.

An alternative approach to secure the device 10 to the club includes the use of a hook and loop fastening system, such as is commonly sold under the tradename VELCRO.

A first part of a hook and loop fastener 38 is attached to the top of the head 36 of the club 12 under where the top plate 14 is disposed and also to the rear face of the club 12 where the back plate 18 is disposed.

A second part of a hook and loop fastener 40 is attached to the recessed area 32 and may encompass a size equal to or less than that of the adhesive tape 16, as desired.

The device 10 is secured to the club 12 by contacting the first and second parts of the hook and loop fasteners 38, 40 together. The device 10 is removed apart from the club 12 by simply applying a force sufficient to separate the first part of the hook and loop fastener 38 apart from the second part of the hook and loop fastener 40. This process can be repeated many times.

To aid in fitting the device 10 on various types of the golf club 12 a first notch 42 and a second notch 44 are formed along the interface between the top plate 14 and the back plate 18. The first and second notches 42, 44 extend from the outside of the device 10 a predetermined distance toward the neck 20 and allow for easier alignment of the top and back plates 14, 18 with the profile of the club 12.

The device 10 can be formed of any preferred material such as plastic or metal or a synthetic material providing the pair of forks 22, 24 can function as described hereinbelow.

In use, the golfer has two alternative ways of acquiring the golf ball 26 by the device 10. A first way is to simply tilt the club 12 backwards until the first fork second end 22*b* and the second fork second end 24*b* are disposed near the surface of the ground. The golfer then urges the club 12 toward the ball 26 so as to permit the first fork second end 22*b* and the second fork second end 24*b* to pass along around and under the ball 26. Once the ball is on top of the pair of forks 22, 24 it is captured.

A second way to acquire the ball 26 is to simply place the pair of forks 22, 24 over the ball 26 and press the club 12 down on top of the ball 26. The pair of forks 22, 24 must include sufficient elasticity (flexibility) to expand to at least the diameter of the ball 26 thereby permitting the pair of forks 22, 24 to pass over the ball 26 beginning at the top of the ball 26, expanding and permitting the pair of forks 22, 24 to pass under the ball 26.

Once the pair of forks 22, 24 have passed over the ball 26 they must then retract so as to retain the ball 26 on the pair of forks 22, 24.

This provides a quick and easy way to acquire the golf ball 26 by the device 10. The pair of forks 22, 24 are simply placed on top of the ball 26 and the club 12 is pressed down until the ball 26 is captured by the device 10.

Then the club 12 with the ball 26 on top are aligned above the Tee 30 and the club 12 is lowered so as to deposit the ball 26 on top of the Tee 30. The club 12 is lowered somewhat more so that the device 10 is disposed below the ball 26. The club 12 is then moved laterally (parallel with the surface) away from the Tee 30. The gap 28 permits passage of the pair of forks 22, 24 away from the Tee 30 leaving the ball 26 disposed on the Tee 30.

The club 12 is then used to strike the ball 26 on the Tee 30 with the device 10 attached thereto. Another ball (not shown) is acquired and the process is repeated as often as the golfer wishes.

As can be seen, a ball striking surface 46 of the golf club 12 is not affected by the device 10, thereby allowing use of the club 12 to strike the golf ball 26 when the device 10 is attached to the club 12.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A golf ball placement device for use with a golf club in placing a golf ball on a golf tee, comprising:

(a) a top plate;

(b) a back plate attached to said top plate and disposed at a angle with respect to said top plate;

(c) a pair of forks attached to said device and extending generally away from said top plate, said pair of forks including a gap between a distal end of each of said forks that is greater than the diameter of said golf tee and a maximum spacing intermediate each of said pair of forks that is less than the diameter of said golf ball, wherein said pair of forks are adapted to flex outward sufficient to pass over said golf ball and to retract under said golf ball sufficient to support said golf ball thereon; and (d) means for attaching said device to said golf club wherein said means for attaching includes means for detatachably-attaching said device to said golf club and wherein said means for detachably-attaching includes a hook and loop fastener.

2. The device of claim 1 wherein a first half of said hook and loop fastener is attached to said device and a second half of said hook and loop fastener is attached to a head of said golf club.

3. The device of claim 1 wherein said device is formed of plastic.

4. The device of claim 1 wherein said device is formed of a metal.

5. The device of claim 1 wherein said device is formed of a synthetic material.

6. The device of claim 1 wherein each of said pair of forks are arcuate members and wherein the space intermediate said pair of forks generally defines an ellipse that is open at said distal end thereof.

7. The device of claim 1 including a neck, said neck attached proximate an interface of said back plate and said top plate and said neck being disposed intermediate said pair of forks, said pair of forks being attached to said neck at an end of said neck opposite where said neck is attached to said interface.

8. The device of claim 1 including a recessed area in said top plate, said recessed area adapted to receive said means for attaching.

9. The device of claim 1 including a recessed area in said back plate, said recessed area adapted to receive said means for attaching.

10. The device of claim 1 including a recessed area in said top plate and in said back plate, said recessed area adapted to receive said means for attaching.

11. The device of claim 1 including a first notch and a second notch, said first notch disposed in said device on one side thereof intermediate said top plate and said back plate and extending toward a center of said device a predetermined amount, said second notch disposed in said device on a second side thereof that is opposite with respect to said one side, said second notch being further disposed intermediate said top plate and said back plate and extending toward a center of said device a predetermined amount.

12. A golf ball placement device for use with a golf club in placing a golf ball on a golf tee, comprising:

(a) a top plate;

(b) a back plate attached to said top plate and disposed at a angle with respect to said top plate;

(c) a pair of forks attached to said device and extending generally away from said top plate, said pair of forks including a gap between a distal end of each of said forks that is greater than the diameter of said golf tee and a maximum spacing intermediate each of said pair of forks that is less than the diameter of said golf ball, wherein said pair of forks are adapted to flex outward sufficient to pass over said golf ball and to retract under said golf ball sufficient to support said golf ball thereon; and (d) means for attaching said device to said golf club wherein said means for attaching includes an adhesive tape.

* * * * *